US005803264A

United States Patent [19]

Gersten et al.

[11] Patent Number: 5,803,264

[45] Date of Patent: Sep. 8, 1998

[54] FOOD AND BEVERAGE CONTAINER CARRIER

[75] Inventors: Albert Gersten, Malibu, Calif.; Ian Behar, New York; Glen A. Thresher, Big Flats, both of N.Y.

[73] Assignee: Alian Paper Products LLC, Encino, Calif.

[21] Appl. No.: 865,002

[22] Filed: May 29, 1997

[51] Int. Cl.[6] ..... B65D 71/00

[52] U.S. Cl. ..... 206/549; 206/194; 206/427; 294/87.2

[58] Field of Search ..... 206/216, 163, 206/167, 169, 175, 193, 194, 199, 427, 549, 541, 200, 446, 443, 562, 563, 486; 294/87–2; 229/904; D7/706

[56] References Cited

U.S. PATENT DOCUMENTS

| | | | |
|---|---|---|---|
| D. 367,409 | 2/1996 | Hunter | D7/706 |
| 3,744,704 | 7/1973 | Struble | 206/194 |
| 3,868,140 | 2/1975 | Gordon | 206/427 |
| 4,155,502 | 5/1979 | Forte | 206/194 |
| 5,135,104 | 8/1992 | Jorba | 206/427 |
| 5,598,920 | 2/1997 | Hansen | 206/434 |
| 5,609,379 | 3/1997 | Harrelson | 206/427 |
| 5,624,024 | 4/1997 | Miess | 206/193 |

*Primary Examiner*—Paul T. Sewell
*Assistant Examiner*—Luan K. Bui
*Attorney, Agent, or Firm*—Hopgood, Calimafde, Kalil & Judlowe, LLP

[57] ABSTRACT

A carrier for beverage containers and food includes spaced upper and lower panels with aligned openings for receiving the beverage containers. A vertical panel extends from the central portion of the upper panel, and a food carrier tray having a slot through which the fingers of the carrier may be passed is fit over the vertical panel. Flaps which provide additional support to the beverage rack portion, limit movement of the beverage containers and provide additional support and stability to the carrier when the carrier is placed on a level surface depend downward from the upper and lower panels at the locations of the openings. Also disclosed is a blank for use in forming the carrier.

11 Claims, 5 Drawing Sheets

FOOD AND BEVERAGE CONTAINER CARRIER

FIELD OF THE INVENTION

The present invention relates generally to paperboard carriers, and more particularly to a paperboard carrier for food and beverage containers.

BACKGROUND OF THE INVENTION

One of the pleasures of attending a sports event or the like at a stadium or arena is the consumption of food and drinks. Although hot dogs, pop corn, and beer and soda are the food and beverages of choice of most individuals, the selection of take-out food and beverages is becoming more varied at many venues.

In most locations, food and beverages are sold at take-out locations remote from the seating sections. The individual who purchases the food and beverage then must carry them to his seat where they are consumed. Since it is typical for one individual to purchase food and drink for more than one person, the food and beverage typically poured into paperboard cups are placed in one or more paperboard carriers in which the individual transports the food and beverage to his seat. The food is typically carried in a paperboard box, and the beverage containers are typically carried in a tray-like structure with pop-up wall structures to receive and support the cups.

One of the main design goals of food and beverage carriers is to permit a maximum number of beverage containers and food articles to be securely and conveniently carried with a minimum risk of spilling the contents. Many different types of food and beverage carriers are in widespread use in stadiums and arenas around the country. One carrier that can be used to carry food in a tray as well as beverages in cups is illustrated in Design Patent No. 367,409. Prior art carriers for beverage containers are described, for example, in Davis U.S. Pat. No. 5,524,814; Porter U.S. Pat. No. 4,155,502; Katzenmeyer U.S. Pat. No. 3,565,323; Ferrington U.S. Pat. No. 2,728,484; Potter U.S. Pat. No. 2,373,851; and Holy U.S. Pat. No. 2,337,197. Other prior art food and beverage carriers are described in U.S. Pat. No. 5,411,204.

Whereas these and other known carriers allow the transport of food and beverage containers from the food stand to the seating area with varying degrees of ease and reliability, they each exhibit certain deficiencies. Perhaps the major deficiency in most, if not all, of the known carriers, is the need for the user to take great care to prevent the beverage containers from tipping during transport with the resulting spilling of beverage. It is also often difficult to carry securely the known food and beverage carriers in one hand, and to place the known carriers securely on a flat surface without the risk of tipping or spilling their contents.

It is an object of the invention to provide an improved carrier for food and beverages.

It is another object of the invention to provide a carrier of the type described that more securely supports the beverage containers during transport.

It is a further object of the invention to provide a carrier of the type described which can be more securely supported when rested on a level surface.

It is yet a further object of the invention to provide a container of the type described which has greater structural integrity than the prior art containers and which can be safely carried in one hand.

It is still a further object of the invention to provide a paperboard food and beverage container which is sturdy and in which more efficient use is made of the paperboard material from which it is formed.

SUMMARY OF THE INVENTION

To these ends, the carrier of the invention includes a portion or rack for holding beverage containers that includes upper and lower panels having openings in vertical alignment for receiving beverage containers. A flap depends from the circumferential edge of at least one of the panel openings to provide additional structural rigidity to the beverage-carrying or rack portion of the container, as well as limit side-to-side movement of the beverage containers carried in the rack. In a preferred embodiment of the invention, the flaps depend downward from diametrically opposed locations on the circumference of circular openings in the upper and lower panels. The flaps that depend from the upper panel extend to the lower panel to provide added strength and rigidity to the beverage-containing rack portion of the carrier, and also to engage and thus prevent movement of the beverage containers that are placed in the openings. The flaps that extend from the lower panel engage the lower ends of the cups and rest on a level surface to provide increased support and balance for the carrier when it is placed on such a flat surface.

The food and beverage carrier of the invention also includes a handle-forming panel which extends upwardly from the beverage-supporting panels. A food-holding tray includes a central longitudinal slit that is placed over the vertical handle-forming panel to allow the user to carry food as well as beverage containers in the same carrier.

To the accomplishment of the above and to such further objects as may hereinafter appear, the present invention relates to a food and beverage container carrier substantially as defined in the claims and as described with regard to a presently preferred embodiment in the following specification as considered with the accompanying drawings in which:

DETAILED DESCRIPTION OF A PREFERRED EMBODIMENT

The Carrier

Figure 1:
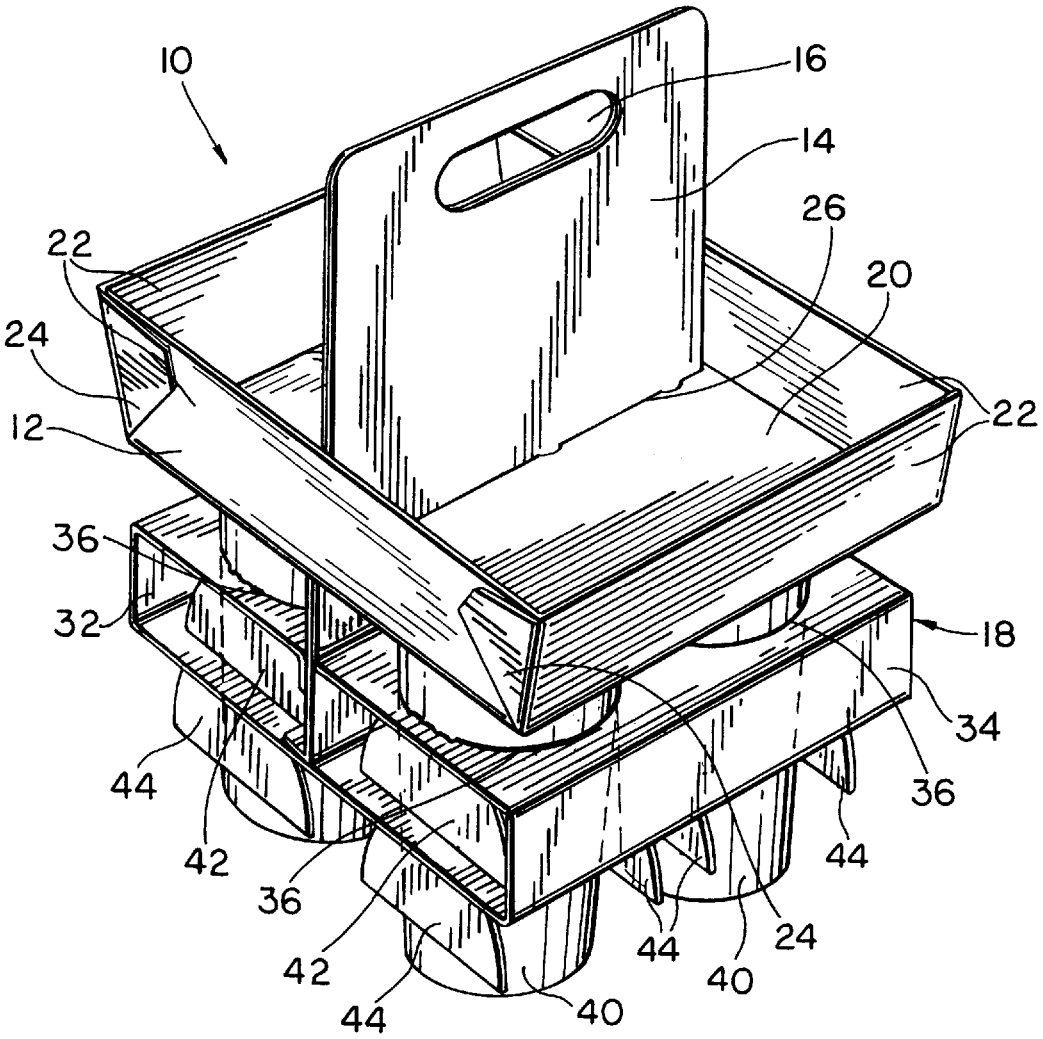
FIG. 1 is a perspective view of a food and beverage carrier according to an embodiment of the invention.

The carrier of the invention, generally designated 10, as in the embodiment illustrated in FIG. 1, includes a food tray 12, an upwardly extending handle section 14, having an aperture 16 through which the fingers of an individual who lifts the carrier may be placed, and a beverage rack 18. As will be described in greater detail below, the handle section 14 and beverage rack 18 are preferably formed from a single sheet of fiberboard, or similar material, in the form shown in FIG. 3.

The food tray 12 includes a bottom panel 20 and upstanding side walls 22 joined at their corners by glued flaps 24. A central horizontal slit 26, formed in bottom panel 20, snugly fits over the upper and side edges of the handle portion 14, as shown in FIG. 1. The handle section 14 includes, as shown in FIG. 2, a notch 15 at each end, which is adapted to engage and thus limit the lowermost position of food tray 12 with respect to section 14.

Figure 2:
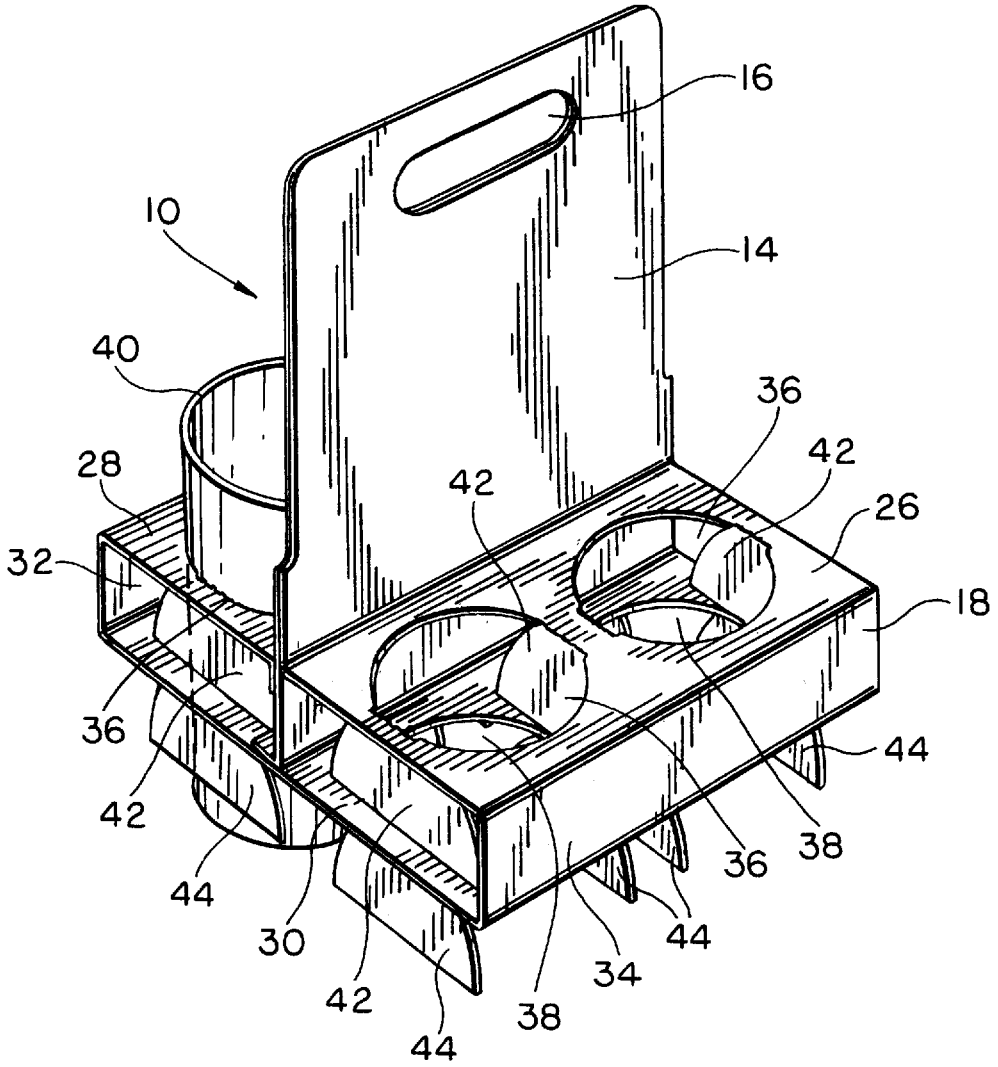
FIG. 2 is a perspective of the carrier of FIG. 1 shown with the food tray removed.

The beverage rack portion 18 includes, as shown best in FIG. 2, upper panels 26, 28, joined at their inner sides near the lower edge of handle section 14, and a lower panel 30 to which the bottom edge of handle section 14 is attached. Upper and lower panels 26, 28 and lower panel 30 are spaced from and joined to one another by end walls 32 and 34. Panels 26, 28 contain four circular openings 36, which are presently circular, three of which can be seen in FIG. 2. Lower panel 30 also includes four circular openings 38, two of which can be seen in FIG. 2. Pairs of openings in the upper and lower panels of the beverage rack portion 18 are in vertical registration with one another. A beverage container or cup 40 can be inserted through each vertically registering pair of openings, such that the lower end of the cup passes through the opening 38 in the lower panel 30. There may be either a greater or lesser number of openings in beverage rack portion 18, and the openings need not, as shown, be circular in shape.

What has thus far been described is conventional. In accordance with the present invention, in the formation of the beverage rack portion 18, the material normally discarded from the blank when the circular openings 36, 38 are formed in the upper and lower panels of rack portion 18, is retained and used to form support flaps or gussets 42, 44, which, when the carrier is in use, depend downwardly from the edges of openings 36, 38 in the upper and lower panels 26, 28 and 30, respectively. The flaps 42 extend between upper panels 26, 28 and lower panel 30 to provide an additional support wall between the upper and lower panels, thereby to increase the strength and rigidity of beverage rack portion 18. The flaps 42, 44 also engage the sides of the cup 40, as seen best in FIG. 2, to provide additional support to, and to prevent side-to-side motion of, the cups 40 carried by the beverage rack portion 18. As also seen best in FIG. 2, when the carrier 10 is placed on a flat surface, the lower flaps 44 that depend from the lower panel 30 contact the surface, thereby to provide additional stability to the carrier.

The Blank

Figure 3:
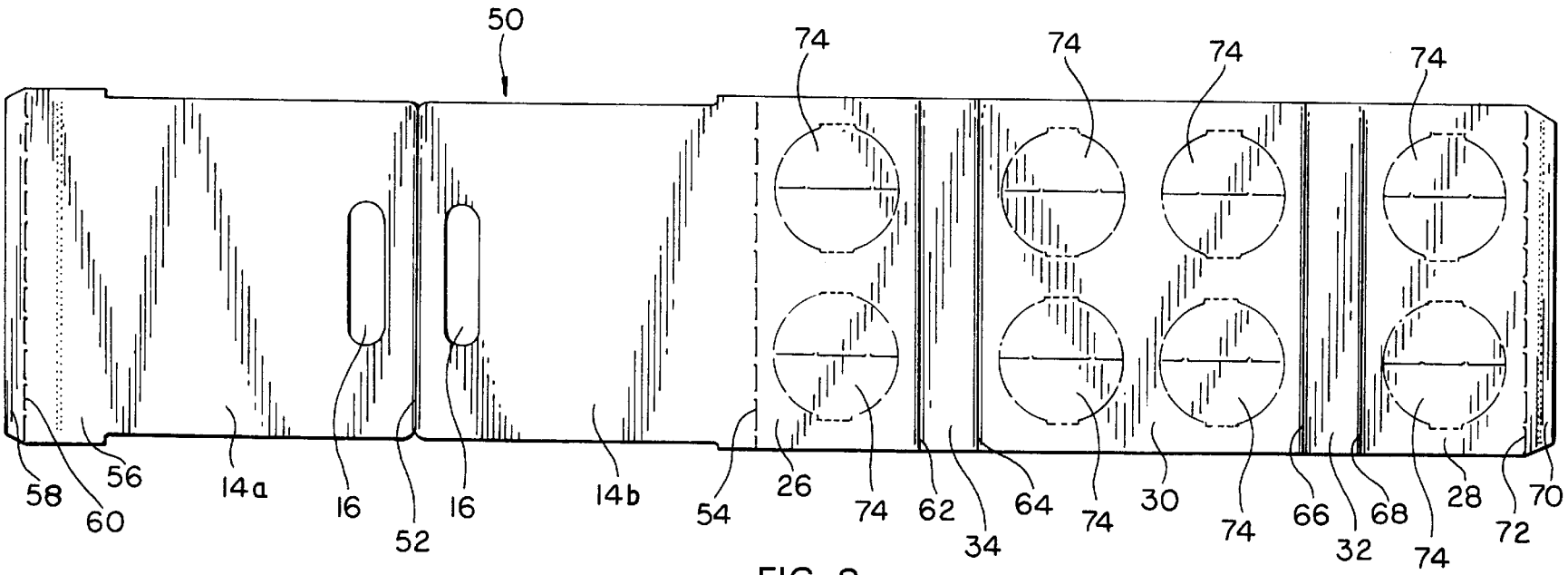
FIG. 3 is a plan view of an embodiment of a blank that can be used to form the beverage rack portion of the carrier of FIG. 1.
Figure 4:
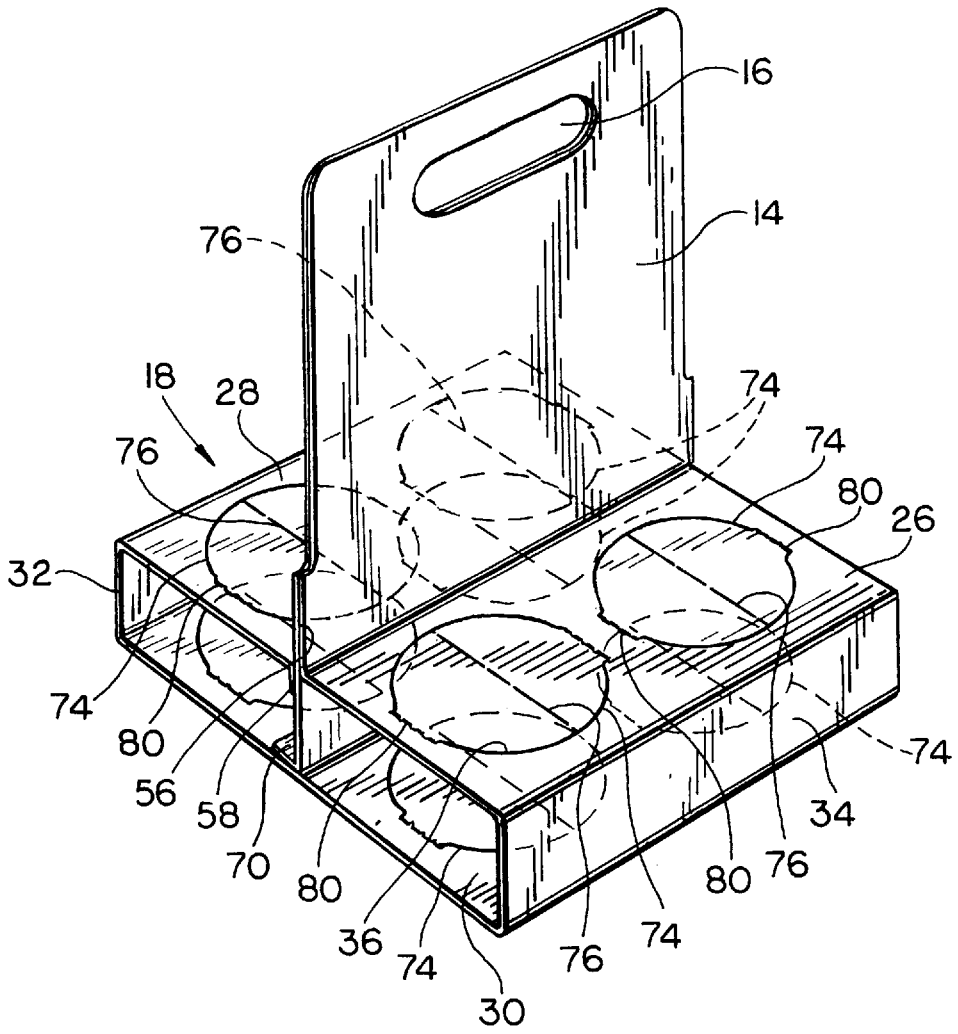
FIG. 4 is a perspective of the beverage rack portion assembled from the blank of FIG. 3.

FIG. 3 illustrates one embodiment of a blank that may be used to form the unitary handle section 14 and beverage container carrier 18 of the carrier 10. The assembled handle section 14 and beverage rack 18 are shown in FIG. 4. The blank in FIG. 3 generally designated 50, includes the two panels 14*a*, 14*b* of handle section 14 hingedly joined together at their upper ends at a fold line 52. The lower end of portion 14*b* is joined at a scored fold line 54. The lower end of portion 14*a* includes a wide section 56 and an adhesive strip 58 joined to section 56 at a creased fold line 60.

The right-hand edge of panel 26, as viewed in FIG. 3, is hingedly joined to one end of wall 34 at a fold line 62. The other end of wall 34 is hingedly joined to one end of panel 30 at a fold line 64. The other end of panel 30 is hingedly joined to one end of wall 32 at a fold line 66, and the other end of wall 32 is hingedly joined to one end of panel 28 at a fold line 68. The other end of panel 28 is joined to an adhesive flap 70 at a scored fold line 72.

In accordance with the present invention, flaps 26 and 28 each include a pair of circular segments and panel 30 includes four such segments. Since all of the circular segments 74 in blank 50 are substantially the same, only one is described herein, it being understood that this description applies equally to all of the circular segments 74.

Figure 5:
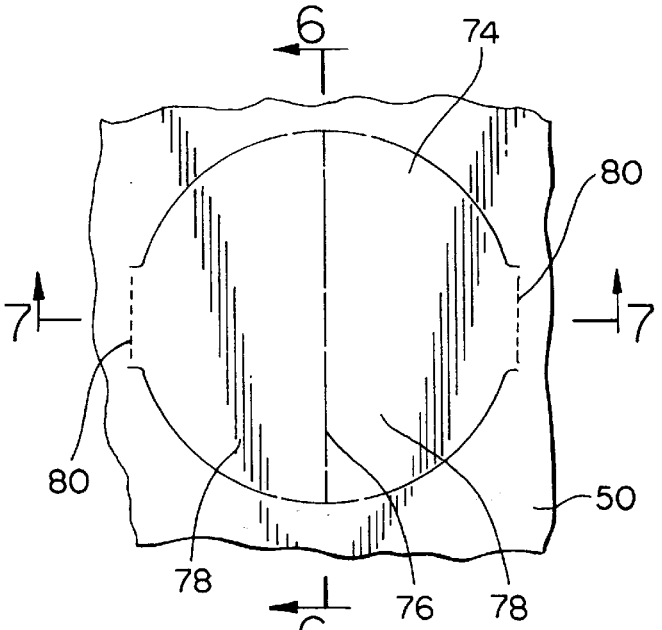
FIG. 5 is an enlarged view in plan of one of the foldout segments of the blank of FIG. 3.
Figure 6:
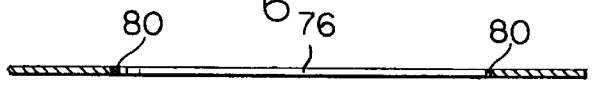
FIG. 6 is a cross-section of the foldout segment of FIG. 5.

As seen best in FIG. 5, each circular segment 74 includes a diametral scored line 76 and two arcuate semicircular flap sections 78, each of which is hingedly affixed at a fold line 80 to its associated panel at a location along the circumference of each circular segment 74. The two fold lines 80 for each circular segment 74 are located at the ends of a diameter of circular segment 74, which extends substantially normal to the diametral scored separation line 76.

Figure 7:
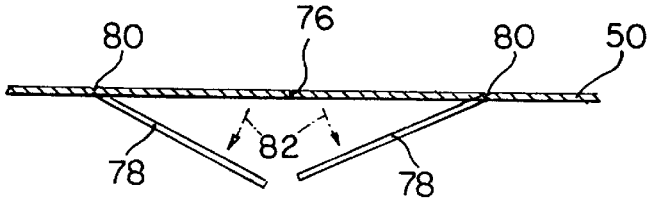
FIG. 7 is a view, similar to FIG. 6, showing the flaps pivoted downwardly.
Figure 8:
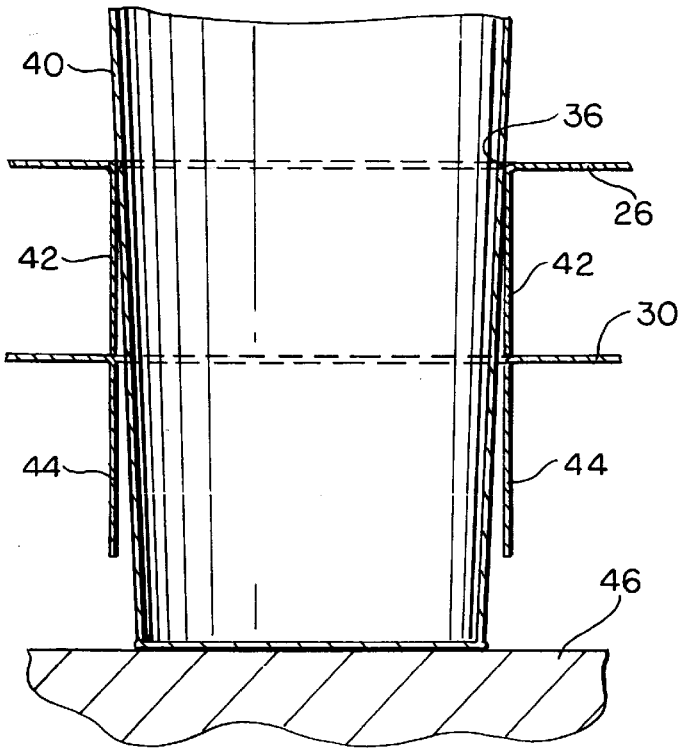
FIG. 8 is a cross-section of the beverage rack portion of the carrier with a cup in place.

Either prior to or after the formation of the unitary beverage carrier and handle portion, illustrated in FIG. 4, in a manner to be described below, the diametral score line 76 in each segment 74 is broken so that each of the arcuate flap segments 78 can be pivoted along lines 80 in the direction of the arrows 82, as shown in FIG. 7. Once the flap segments 78 are moved to an essentially downwardly depending, vertical orientation they become the flaps 42, 44 of the final carrier construction shown in FIGS. 1 and 2. Although the flaps 42, 44 are herein illustrated as having an arcuate or semicircular shape, they may be of other shapes if desired. In addition, more or less then the two flaps described may be formed at the openings in the upper or lower beverage rack portion panels.

To assemble the carrier of FIG. 2 from the blank 50 of FIG. 3, the blank is folded along fold lines 52, 54, 60, 62, 64, 66, 68 and 72. Adhesive strip 58 is attached to a central portion of lower panel 30 at a position intermediate the two rows of circular segments 74 therein. If desired, panels 14*a* and 14*b* may be attached to one another by the use of any suitable adhesive. Thereafter, adhesive strip 70 is secured to the lower portion of panel 14*b* to form the structure illustrated in FIG. 4. Thereafter, the flap segments 78 are separated along lines 76 and pivoted downwardly to achieve the position of flaps 42, 44 in FIGS. 1 and 2.

In use, the beverage rack portion 18 initially lies flat with its upper panels 26, 28 resting on the lower panel 30, and the flaps 42, 44 lying in the flat plane of the upper and lower panels. When one or more beverage containers is placed in the beverage rack portion 18, the force of the cup being inserted into the rack portion 18 pushes through the openings 36 and cause the flaps 42, 44 to pivot downwardly from the panels 26, 28 and 30 to their positions shown in FIG. 2. The food tray 12 is then placed over section 14 and pressed downwardly until it comes to rest on the upper rim of the beverage containers, as shown in FIG. 1.

It will be understood that the provision of the flaps 42, 44 in the carrier of the present invention provide increased rigidity to the beverage rack portion as well as improved retention and control of the beverage containers carried therein, and allow the carrier to be placed on a flat surface with greater stability. If desired, the vertical handle panels, as well as the walls of the food tray and beverage container carrier, may have printed thereon advertising or promotional material or other text or illustrations. It will be further understood that whereas the invention has been described hereinabove with respect to a currently preferred embodiment, variations may be made to the described structure without necessarily departing from the spirit and scope of the invention.

What is claimed is:

1. A carrier for carrying one or more beverage containers comprising a beverage rack portion and a handle portion affixed to said beverage rack portion, said beverage rack portion including vertically spaced upper and lower horizontal panels having first and second axially aligned openings respectively formed therein, and at least one flap secured to and extending downward from at least said upper panel at the location of said first opening and extending downward toward the upper surface of the said lower panel for engaging a beverage container received in said first and second openings and for providing additional rigidity to said carrier.

2. The carrier of claim 1, further comprising a food service tray carried by said handle portion.

3. The carrier of claim 1, further comprising a second flap depending downwardly from said second opening in said lower panel at the location of said second opening.

4. The carrier of claim 3, in which a first and second pair of flaps are hingedly secured at opposite ends of said first and second openings in said upper and lower panels, respectively.

5. The carrier of claim 3, in which said second pair of flaps extend to a level surface on which said carrier is placed.

6. The carrier of claim 1, in which a pair of flaps are hingedly secured at opposite ends of each of said first and second openings.

7. The carrier of claim 6, in which said first pair of flaps extends substantially between said upper and lower panels, thereby to provide additional rigidity to said beverage rack portion.

8. The carrier of claim 1, further comprising a vertical wall extending between said upper and lower panels in a plane substantially parallel to the plane of said downward extending flaps.

9. A combined food and beverage carrier comprising a beverage rack portion, a vertical handle portion affixed at its lower end to said beverage rack portion, a food tray carried by said vertical handle portion, said beverage rack portion including vertically spaced upper and lower horizontal panels, first and second openings vertically aligned with one another formed respectively in said upper and lower panels for receiving a beverage container thereon, and first and second pairs of flaps depending downward from said upper and lower panels, respectively, at the locations of said first and second openings for engaging the periphery of a beverage-container carried therein, said first pair of flaps extending substantially vertically between said upper and lower panels, thereby to provide additional rigidity to said beverage rack portion.

10. A blank for forming a beverage carrier, said blank comprising a central panel, first and second spaced side panels, first and second intermediate wall portions each hingedly attached respectively at one edge to said first and second panels and at its other edge to said central panel, first and second circular segments formed in said first and second side panels, respectively, and at least a third circular segment formed in said central panel, each of said circular segments comprising a pair of semicircular flaps separated along one diameter of said circular segment and hingedly secured to said panel in which it is formed at a portion of the circumference of said circular segments.

11. The blank of claim 10, in which the hinged attachments of said flaps are located at the ends of a second diameter of said circular segment that is substantially normal to said one diameter.

* * * * *